US005915261A

United States Patent [19]

Chan

[11] Patent Number: 5,915,261

[45] **Date of Patent: *Jun. 22, 1999**

[54] TOY ELECTRONIC INFORMATION STORAGE MEDIUM

[75] Inventor: Ying-Kit Chan, Houston Centre, The Hong Kong Special Administrative Region of the People's Republic of China

[73] Assignee: Scientific Toys Ltd., Chai Wan, The Hong Kong Special Administrative Region of the People's Republic of China

[ * ] Notice: This patent is subject to a terminal disclaimer.

[21] Appl. No.: 08/542,807

[22] Filed: Oct. 13, 1995

Related U.S. Application Data

[63] Continuation of application No. 08/289,091, Aug. 11, 1994, Pat. No. 5,651,681.

[51] Int. Cl.[6] ..... G06F 13/00; A63H 33/30; G11C 17/00

[52] U.S. Cl. ..... 711/115; 711/104; 365/52; 446/408; 463/44; 463/43

[58] Field of Search ..... 395/442, 429, 395/430, 431, 432; 446/299, 302, 318, 404, 408; 273/433, 434, 435; 365/52; 364/410; 463/43, 44, 45, 46; 711/115, 102, 103, 104

[56] References Cited

U.S. PATENT DOCUMENTS

| | | | |
|---|---|---|---|
| 4,502,130 | 2/1985 | Kuckuk | 365/52 |
| 4,639,225 | 1/1987 | Washizuka | 434/308 |
| 4,820,233 | 4/1989 | Weiner | 446/303 |
| 5,055,947 | 10/1991 | Satoh | 360/132 |
| 5,095,798 | 3/1992 | Okada et al. | 463/35 |
| 5,184,971 | 2/1993 | Williams | 446/142 |
| 5,433,610 | 7/1995 | Godfrey et al. | 434/169 |
| 5,651,681 | 7/1997 | Chan | 434/308 |

*Primary Examiner*—Glenn Gossage
*Attorney, Agent, or Firm*—Amster Rothstein & Ebenstein

[57] ABSTRACT

A storage medium designed to simulate a standard information storage medium such as a floppy disk, video tape, or compact disc. A toy playback system accesses information stored on a printed circuit board, integrated circuit or other storage area, disposed on the storage medium. The storage medium comprises a plurality of memory locations each of which stores a sequence of analog or digital signals representative of a different block of stored information. Upon insertion into the toy playback system based upon user input, the printed circuit board or integrated circuit comes into selective contact with a contact plate, which activates the contacted memory location or locations to provide the selected information as sounds image, or video via a speaker, display screen, or combination thereof. The sound or audio information may be stored in a plurality of voice chips on the printed circuit board. The playback system may additionally include preloaded storage locations and available storage space for user recording or storing of information.

8 Claims, 5 Drawing Sheets

TOY ELECTRONIC INFORMATION STORAGE MEDIUM

This is a continuation of application Ser. No. 08/289,091 filed on Aug. 11, 1994, now U.S. Pat. No. 5,651,681.

FIELD OF THE INVENTION

The invention relates to the field of electronic information actuating machines. More specifically, the invention relates to a system adapted for juvenile use, which system provides for the playback of information stored on a printed circuit board or integrated circuit located on a simulated information medium, such as a simulated floppy disk, video tape, compact disc, disc (CD), liquid crystal display (LCD), etc.

BACKGROUND OF THE INVENTION

In the arena of electronic information sources, a variety of high density storage and playback media have been developed. For storage of audio information, audio tape as cassettes, digital audio tapes, and compact discs are available; while video cassette tapes, compact disc and floppy discs provide visual and, frequently, audio-visual information via operation in corresponding playback equipment. Both the information storage medium and the playback equipment tend to be regarded as high technology items which are not adapted for juvenile usage.

One disadvantage of high technology storage media and playback equipment is cost. At this time, the technology remains costly largely due to the necessary materials and the production expenses for recording the stored information. Further, although considered durable under "normal" usage, discs and tapes cannot withstand rough handling of the type associated with a juvenile user. The foregoing disadvantages render the available storage media generally useful to adults rather than children. However, children wish to emulate adult users and have, in the past, had a wide selection of toy versions of, for example, phonograph and tape players. Tape players have been adapted for juvenile users primarily by fabricating the outside of the tape player and the operating switches of highly durable materials. The storage medium, i.e., the tapes, themselves, and the basic internal tape recording and playing mechanisms are the same as are found in all standard tape players. As a consequence, repeated usage by a juvenile has its expected effect on the storage medium and the playback equipment's internal components.

One particularly popular toy phonograph of the past featured plastic discs having grooves to simulate the grooves on phonograph records. Each plastic disc was provided with a plurality of grooves representing a single melody. The "record player" comprised an arm, much like the needle arm of a phonograph player; however, the toy arm had multiple actuating pin means similar to those in a mechanical music box. The grooves on the spinning record selectively actuated the pins, each of which was coupled to emit a particular musical tone, the combination of which provided the basic melody. Both the recording medium and the player were fabricated of highly durable materials, insuring long term play value. Moreover, since each plastic disc contained a single melody, ease of selective access to the desired information was available to the juvenile user. Toy computers provide visual display of images stored on a reel of sheeting which is advanced, on a "frame-by-frame basis, via user activation of a simulated keyboard.

It would be advantageous to provide a durable, affordable easily operated, toy playback system for providing selective access to stored information, for the use and enjoyment of juvenile users.

It is therefore an objective of the present invention to provide a toy playback system which can selectively provide stored information from one or more storage media.

It is a further objective of the present invention to provide a method and system for storing, selectively accessing, and reproducing audio and/or visual information, the method and system being durable portable and affordable.

SUMMARY OF THE INVENTION

These and other objectives are realized by the present invention wherein a toy playback system is adapted to access information stored on a printed circuit board, an integrated circuit (IC), or multiple IC's, disposed on a toy storage medium, designed to simulate a standard tape or disc-type information storage medium. The integrated circuit includes a plurality of Read Only Memory (ROM) locations, each of which stores a sequence of analog or digital signals representing a different block of stored information. Upon insertion into the toy playback system, the integrated circuit comes into contact with an internal contact plate which activates the contacted ROM location or locations to provide the selected information as sound, image, or video on the speaker, display or combination thereof. Physical displacement of the contact plate, by user actuation of a particular button on the toy playback system, results in the plate contacting a different ROM location and the system providing different information. The playback system reproduces the information either electronically or mechanically, and may be adapted to receive more than one type of simulated storage media and to provide information stored within the playback unit itself. Further, the storage area on the simulated medium may include available storage space for "recording" onto the storage medium.

BRIEF DESCRIPTION OF THE DRAWINGS

The invention will now be described in detail with specific reference to the Figure in which.

DETAILED DESCRIPTION OF THE PREFERRED EMBODIMENT

As set forth above, the invention can be applied to simulate a variety of high technology storage media and playback equipment. The printed circuit boards or integrated circuits are store and provide information on a portable, removable, simulated medium such as toy versions of floppy disks, compact discs, audio cassette tapes, video cassette tapes, digital audio tapes (DATs), etc. The playback system, simulating a computer, CD player, cassette tape player, videocassette recorder, DAT player, etc., for each of the respective simulated storage media has basically the same internal mechanism, as described below, although the outside appearance of each may be altered to more closely resemble the high-tech component after which each is modeled.

Figure 1:
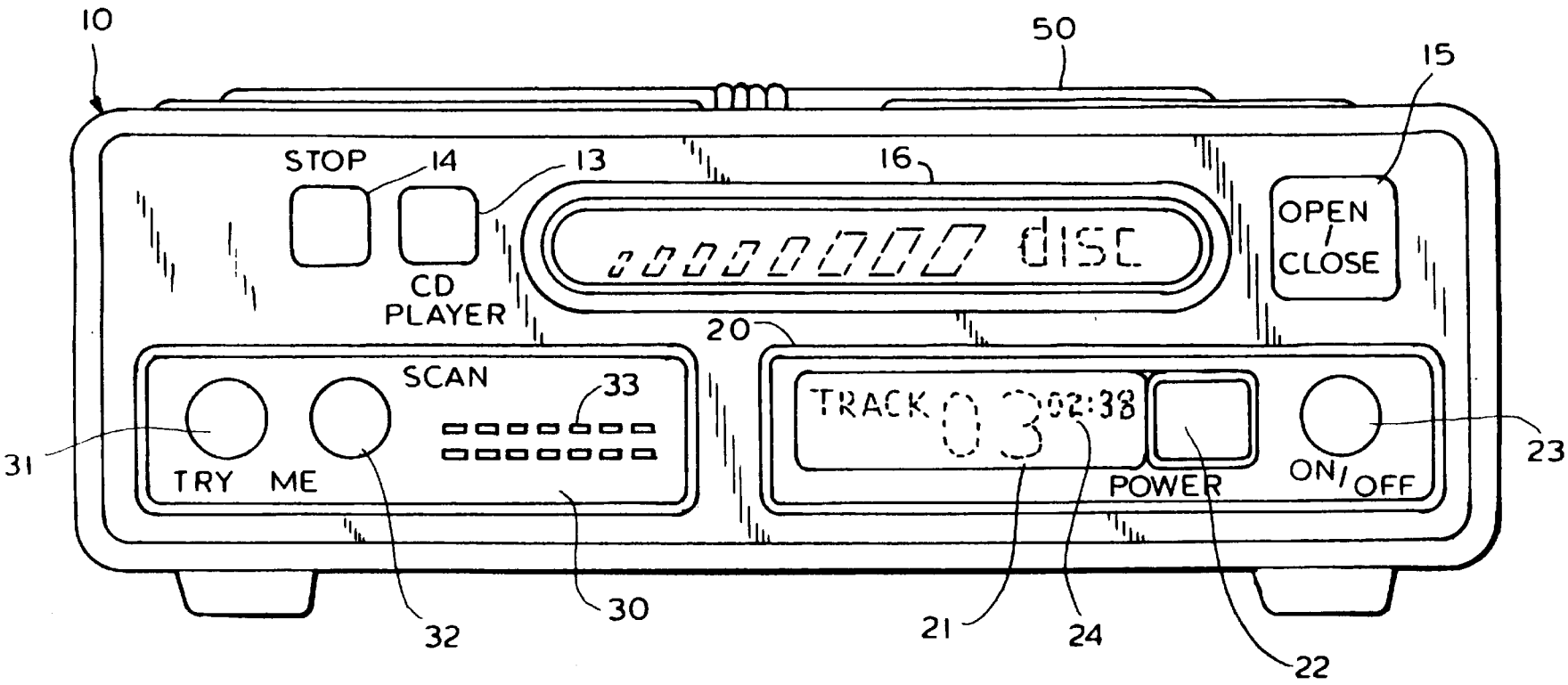
FIG. 1 provides a schematic illustration of the outside of a toy compact disc player made in accordance with the invention.

The invention will first be described with reference to the Figures wherein toy audio storage media and an associated audio playback system are illustrated. With reference to FIG. 1, a toy compact disc (CD) player 10 is described herein. Clearly, many of the described features are optional and can be combined, eliminated or otherwise modified as desired without departing from the invention. The playback system of FIG. 1 has an ON/OFF power button, 23, for powering the compact disc player, and POWER light, 22, which indicates that the player has been connected with the power source. In accordance with principles and practices well known in the art, the playback systems of the present invention can be adapted to connect to either a battery or AC power source, as available. The CD player is also provided with a plurality of selection means, including scan button 32 for activating the CD player and "STOP" button 14 for deactivating the player (i.e., the "OFF" button for the CD player). Button 15 is operable to open and close bay 16 into which a toy CD is inserted for play. Finally, control button 31, labeled "TRY ME", is provided to allow the user (or potential purchaser) to listen to the sound quality of the system and test the display functions (e.g., light indicators) of the playback unit.

The "SCAN" 32 button may be adapted to have several functions: (a) to start play of the CD, and (b) to sequentially step through the songs on the "disc." The CD player will continuously play the same song unless the SCAN button is depressed. If a user wishes to fast forward through the selections on the disc, the user must repeatedly depress the "SCAN" button. In order to stop and listen to a particular selection on the CD disc, the user releases the "SCAN" button, whereby the selection will be played and repeated, unless the "SCAN" button is again depressed. If the "SCAN" button is depressed, contact is made so as to access the next successive ROM location and the CD player provides the next song. Once the last selection has been reached, depressing the SCAN button will once again contact the first selection.

Optional display 20 indicates the track, at 21, which is currently being played and the elapsed playing time, at 24, for the selected track and a further visual indication, at 33, of the beat of the selected track which is being played. Optional volume control may also be provided. As will be apparent to one having skill in the art, the foregoing features are matters of design choice which are not germane to the basic invention, but only to a usable and marketable implementation thereof.

Figure 2:
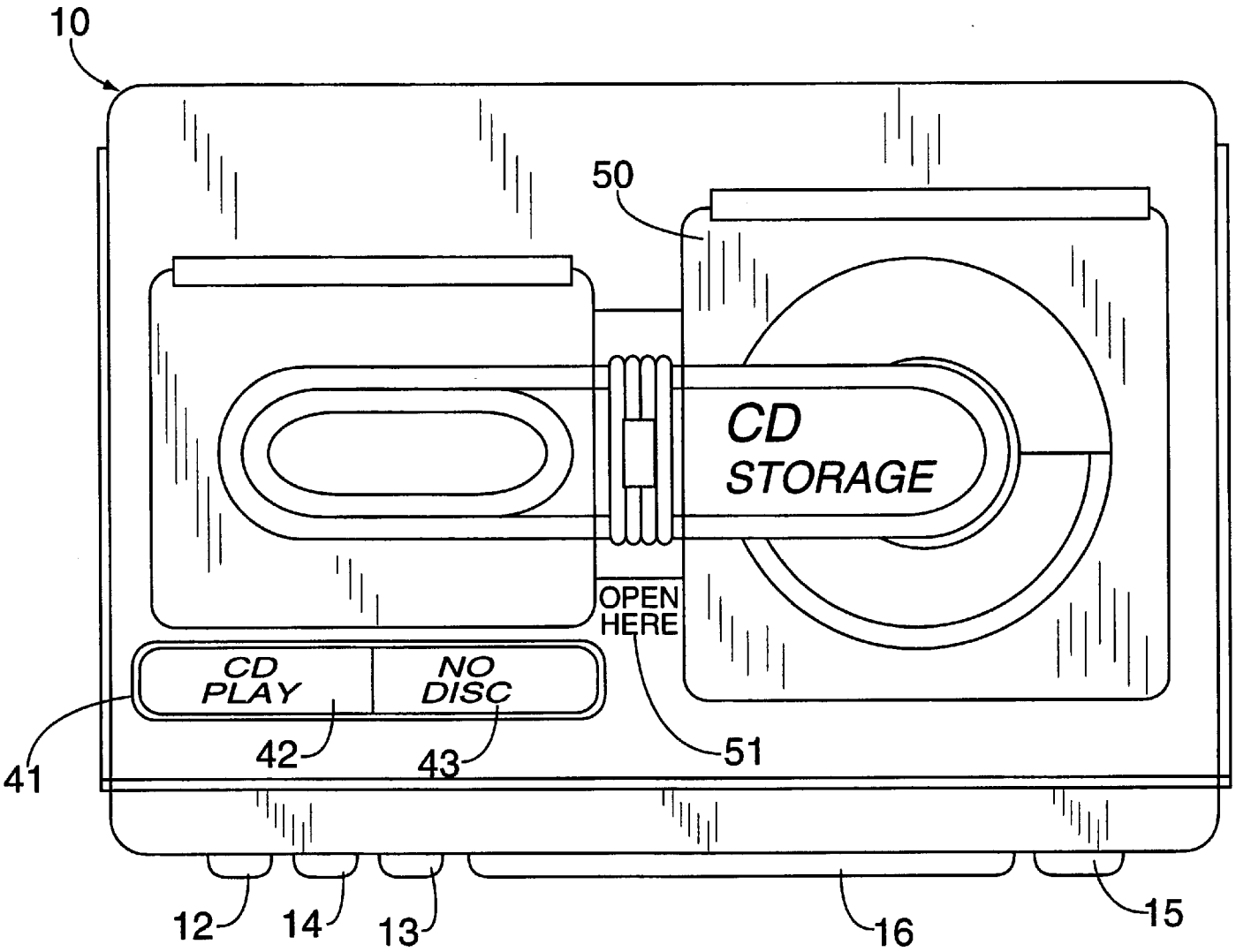
FIG. 2 provides a schematic view of the top of the toy compact disc player with a CD storage bay and player condition indicator means.

As depicted in FIG. 2, which provides an overview of the top of the inventive CD player 10, the player may have a storage bay 50 for storing the toy discs when not is use. Mechanical latch 51 may be provided for opening the storage bay. The top of the CD player also has optional display means 41 for displaying the current condition of the player, specifically if a CD, at 42, is playing or if no CD, at 43, has been inserted for play.

Figure 3A:
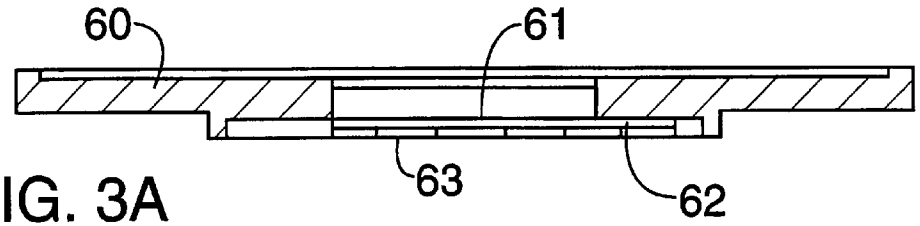
FIGS. 3*a* and 3*b* provide schematic cross-sectional and plan views, respectively, of a toy compact disc storage medium in accordance with the present invention.
Figure 4:
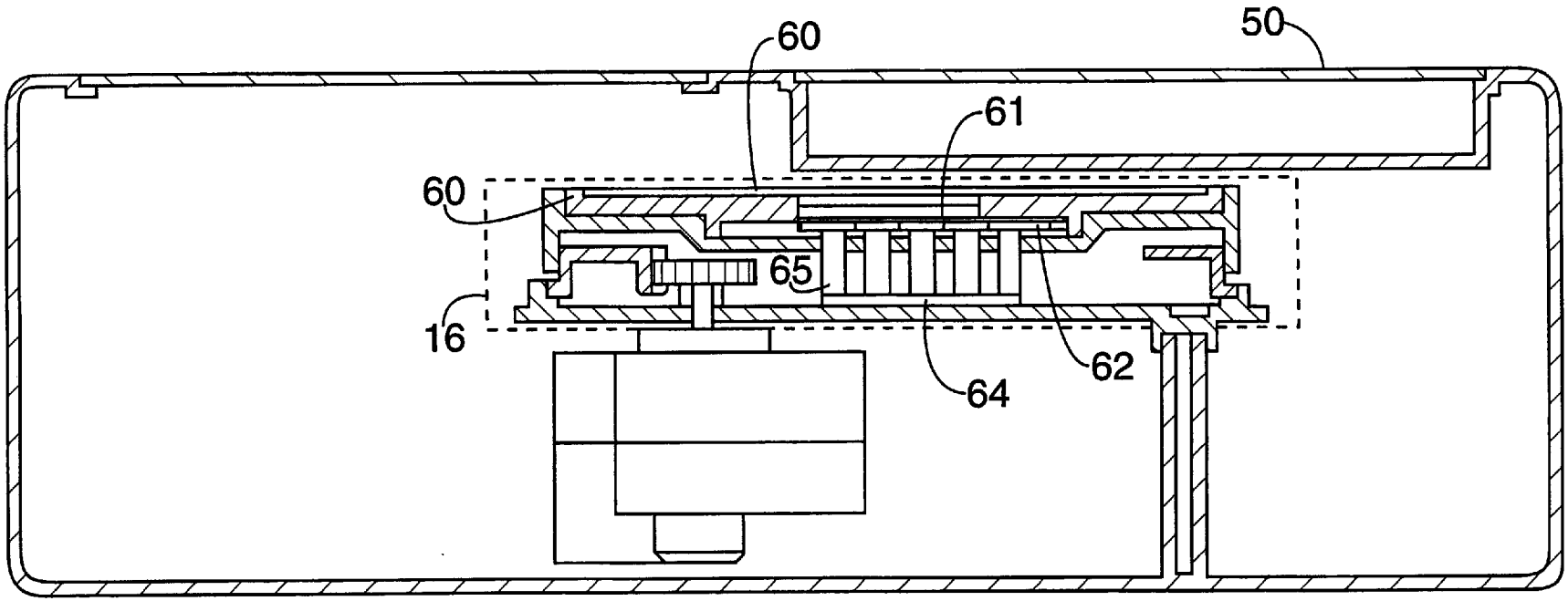
FIG. 4 provides a cross-sectional view of the toy CD storage medium in the toy CD playback system.
Figure 3B:
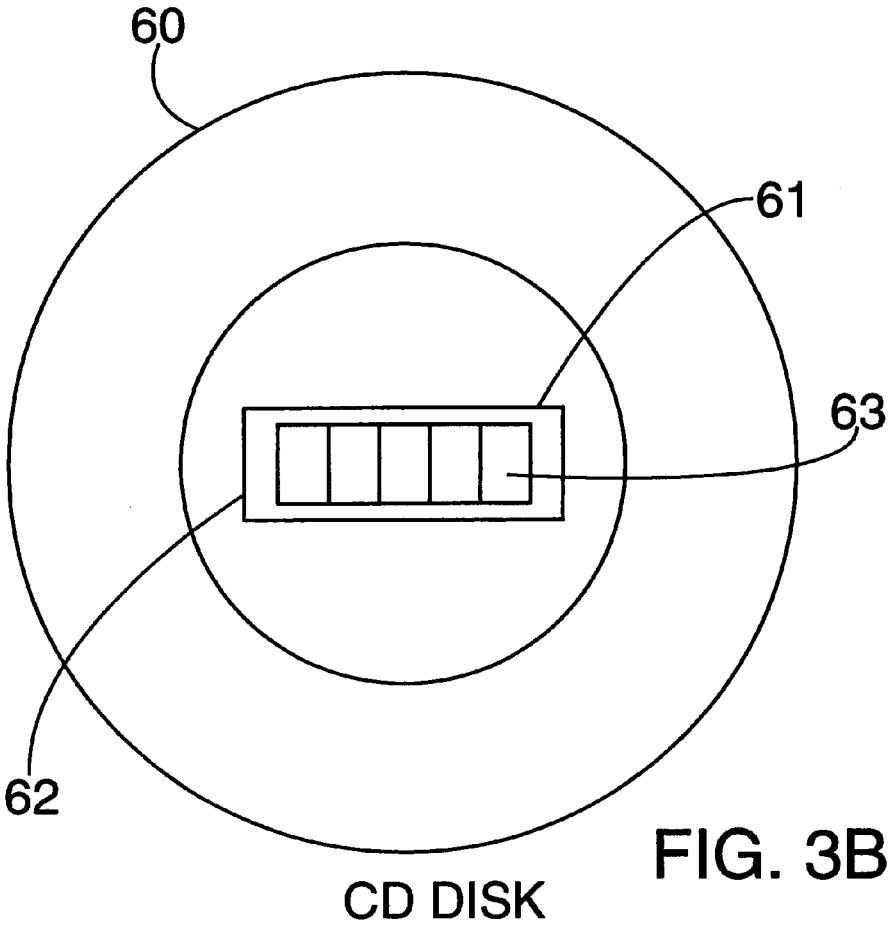
Figure 5:
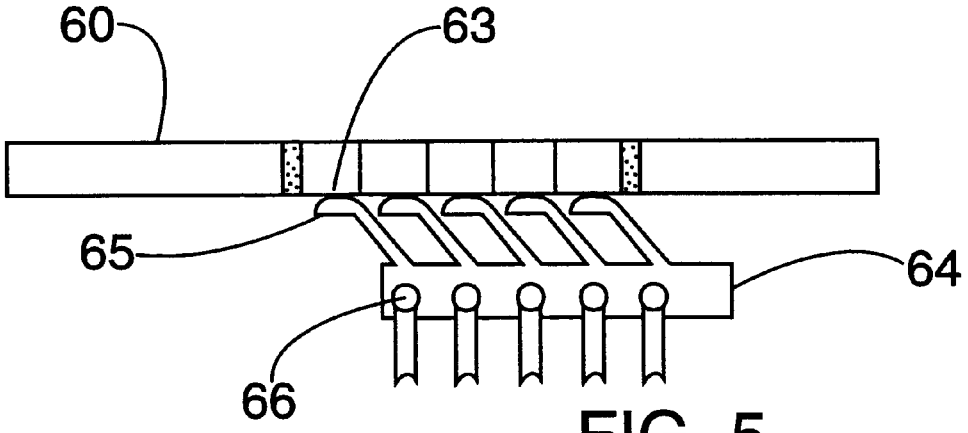
FIG. 5 illustrates a contact plate in proximity to the integrated circuit contact areas on a simulated storage medium in accordance with the present invention.

The inventive toy storage media are durable plastic replicas of actual storage media. The toy versions of the tapes, discs, etc. are equipped with integrated circuit means including ROM locations for storing the information. FIGS. 3*a* and 3*b* illustrate a toy CD 60 representative of the present invention. Printed circuit board 62 is disposed on the "CD" in a recessed manner. The printed circuit board 62 for the audio medium implementation has a plurality of voice chips with contact surfaces 63 disposed along its surface and related circuitry in area 61. Each voice chip stores and provides an audio selection when activated. When the CD 60 is inserted into the player, see FIG. 4, through bay 16, the printed circuit board 62 faces the contact plate 64 of the player mechanism. Upon user activation of the player, e.g., by depressing button 32 of FIG. 1, the contact plate 64 is moved into contact with the printed circuit board and a voice chip is activated, whereupon the chip provides its stored audio information to transducing means which reproduces the audio selection for user enjoyment. The contact plate is comprised of a plurality of contact "fingers", 65, each of which is connected by a control switch 66 to the user activation button or buttons on the playback system. Each contact finger 65 is aligned to engage a different contact surface on the printed circuit board, and consequently a different voice chip disposed thereon. In a normal "PLAY" mode, the player moves the contact fingers into contact with the voice chips on the printed circuit board in sequential manner by depressing the "SCAN" button, thereby providing complete audio play for each of the "recorded" tracks. Clearly, the contact component can be a stationary contact pin, a contact plate, or a series of pins or plates or other mechanical/electrical connection means as are available in the art. The illustrated fingered contact plate is merely representative of a workable implementation.

If a user wishes to sample the audio selections, he depresses the "SCAN" button, whereupon the player mechanism moves a contact finger 65 of the contact plate 64 into contact with the contact surface 63 of a voice chip on the printed circuit board 62. Successive depression of the "SCAN" button results in the neat successive voice chip being contacted by the successive contact finger, and resultant performance of the next successive audio selection. The contacted voice chip emits its stored audio selection until it is no longer contacted by the contact finger. Display 20 can optionally provide the track number, at 21, for the audio selection being sampled at each interval, allowing the user to make note of the track number for a desired selection. Clock means can also be connected to switch the contact fingers at present intervals for automatic scan operation.

In a similar manner, a toy audio cassette or toy digital audio tape, not shown, can be selectively contacted by the contact fingers of a contact plate in order to activate the appropriate voice chip disposed on the printed circuit board or integrated circuit embedded in the toy tape. With respect to the video CD, video cassette, LCD display, diskette and floppy disk simulated storage media, the corresponding playback units require visual display means for presenting the stored image or video selection, in combination with, or alternative to, the audio performance means. Larger storage requirements and multiple media (i.e., image and audio, video and audio, etc.) requirements may necessitate the use of multiple integrated circuits, as will be apparent to a skilled practitioner.

Figure 6:
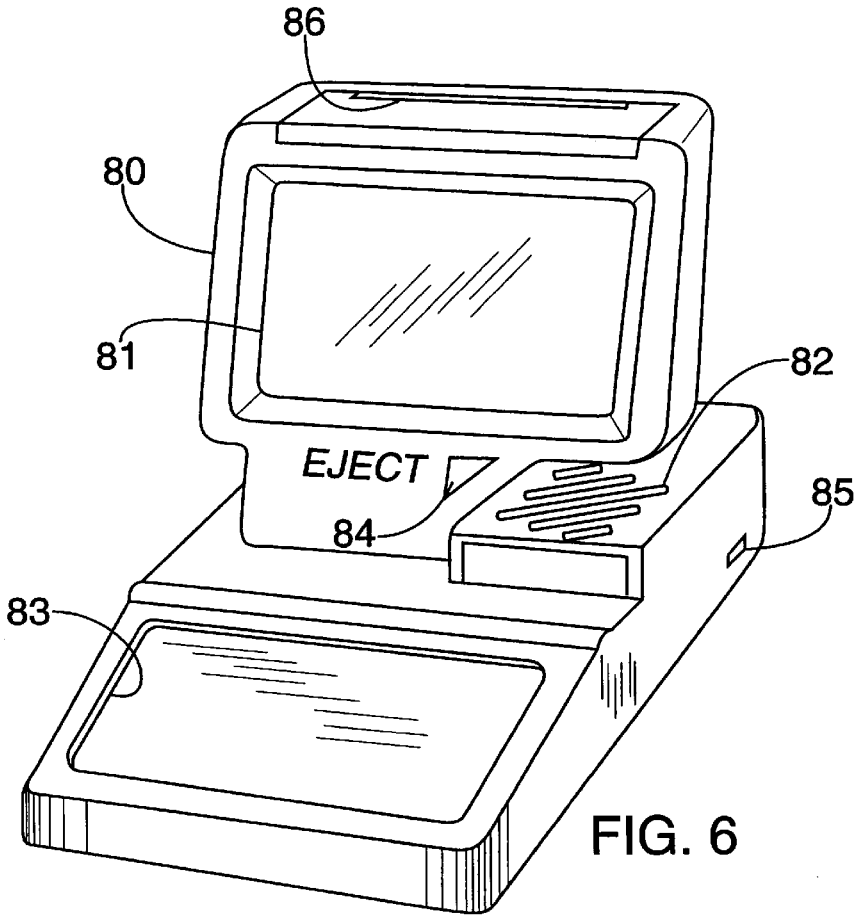
FIG. 6 illustrates a simulated personal computer playback system in accordance with the present invention.
Figure 7A:
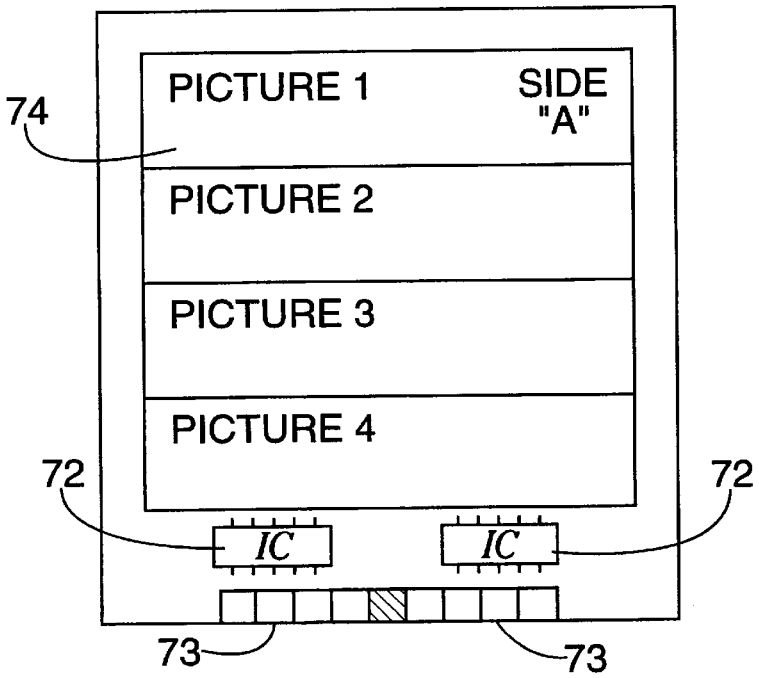
FIGS. 7*a* and 7*b* provide plan and cross-sectional views, respectively, of a simulated floppy disc or computer diskette for use with the simulated personal computer playback system.
Figure 7B:
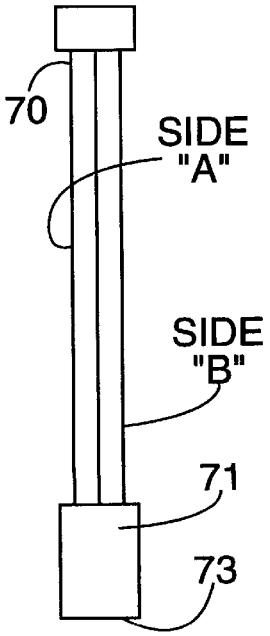

FIG. 6 illustrates a simulated personal computer playback system for providing combined audio and image display from simulated computer diskettes, as schematically illustrated in FIGS. 7*a* and 7*b*. The toy discs, fabricated to simulate five and one quarter (5¼) inch floppy disks or three and one half (3½) inch computer diskettes, are adapted to provide both audio information, from voice chips, and image information, stored elsewhere on the diskette. The schematically illustrated diskette 70 includes contact surfaces 73 disposed on the bottom surface of the diskette for contacting a contact plate, pin, or alternative when inserted into the toy personal computer playback system at diskette slot, or drive, 86 on FIG. 6. Each contact surface 73 is connected to a voice chip on one of the integrated circuits 72 and to an image storage area 74. Therefore, user input of a desired selection results in visual display of the image at display screen 81 of information obtained from image storage area 74 via playback image conversion circuitry (not shown), along with audio performance of the related stored audio information from IC 72. Audio "display" is output via speaker 82 on the computer playback system 80. User input, at simulated keyboard or keyboard 83 advances the computer playback system contact plate (not shown) into contact with the next successive contact surface of diskette 70 to provide the next successive image and related audio selection. The computer playback system 80 is additionally equipped with ON/OFF power switch 85 and EJECT button 84 for removing the diskette.

FIG. 7*b* illustrates the simulated computer diskette having image and audio storage on both sides of the diskette. The playback system can be adapted to have multiple contact plates, one for contacting surfaces on each side of the diskette, or, alternatively, the user can insert the diskette to provide "SIDE A" information and after re-insert the diskette with the display facing reversed in order to obtain "SIDE B" information.

As noted above, the playback system may provide for mechanical or electronic display of the selected information. In the simulated computer playback system, the image information may be stored as analog image data whereby selected display is obtained simply by aligning the selected stored image with image conversion means (not shown), which means is adapted to couple aligned stored images to display screen 81. The stored image may be a scaled analog version of that which will be provided at display screen 81. In such an instance, user selection of the image results in an image conversion magnifying means being aligned with the selected image in order to generate the magnified image at display screen 81. Similarly, an "encoded" analog image may be stored in area 74 and the image conversion means may be adapted to both decode and scale the image for display at screen 81. Mechanical switch means may be provided for aligning the image conversion means to the selected stored image information in response to user input at keyboard 83, while the same user input aligns the relevant contact finger of the computer playback system's contact plate to the integrated circuit contact surface for retrieval of the audio information related to the displayed image.

Clearly, display of stored video information may additionally be activated by contacting appropriate contact surfaces coupled to either analog video playback circuitry, digital video reproduction circuitry, mechanical analog film strip advancing mechanisms, etc., with the obvious limitations of cost and durability as defined by the user market.

Any playback system in accordance with the invention may also be equipped with recording means whereby a blank temporary storage memory device (e.g., a digital erasable programmable read only memory (EPROM on a printed circuit board embedded in the toy storage medium) is inserted into the playback system and user input to a microphone or keypad/keyboard is "recorded" on the temporary storage means. Pre-stored sounds and data, stored in ROM memory devices internally stored in the playback system, can additionally be accessed for audio play, visual display, and/or "recording" on the temporary storage means.

While the invention has been described with reference to several specific embodiments, one having skill in the art will recognize that modifications may be made without departing from the spirit and scope of the appended claims.

We claim:

1. A removable toy information storage medium for use with playback equipment comprising:

a housing;

a memory storage device having one or more memory regions for storing at least one of image data or sound data;

a printed circuit board disposed on said housing having a plurality of electrical contact points each contact point being associated with said one or more memory regions for selectively gaining access to said at least one of image data or sound data; and said housing, printed circuit board, memory storage device and electrical contact points cooperating to simulate the operation and appearance of a conventional storage medium.

2. The toy information storage medium of claim 1 wherein said memory storage device comprises an integrated circuit having at least one read only memory location for statically storing said at least one of image data or sound data.

3. The toy information storage medium of claim 1 wherein said memory storage device comprises at least one voice integrated circuit for storing sound data.

4. The toy information storage medium of claim 1 wherein the operation and appearance of a compact disc storage medium is simulated.

5. The toy information storage medium of claim 1 wherein said memory storage device further comprises a blank temporary storage means for recording at least one of image data or sound data.

6. A removable toy information storage medium adapted to simulate the operation and appearance of a conventional storage medium for use with playback equipment comprising:

a first memory storage device having one or more memory regions for storing a first type of information;

a second memory storage device having one or more memory regions for storing a second type of information related to said first type of information; and said first type and related second type of information being output to said playback equipment via a plurality of contacts associated with said one or more memory regions of said first and second memory storage devices for use cooperatively by said playback equipment.

7. The removable toy information storage medium of claim 6, wherein said first type of information comprises image data and wherein said second type of information comprises audio data.

8. A removable toy information storage medium adapted to simulate the operation and appearance of a conventional storage medium for use with playback equipment comprising:

first and second opposing sides each having a surface area substantially greater than the surface area of any other side of said storage medium;

an integrated circuit storage means having read only memory locations for storing at least one of image data or sound data and output means associated with said first opposing side an integrated circuit storage means having read only memory locations for storing at least one of image data or sound data and output means associated with said second opposing side; and said integrated circuit storage means and output means of said first and second opposing sides being selectively accessible for outputting information therefrom such that distinct information may be accessed from each of said first and second opposing sides.

* * * * *